United States Patent [19]

Lund

[11] Patent Number: 4,460,032

[45] Date of Patent: Jul. 17, 1984

[54] METHOD AND APPARATUS FOR BLOWING CORES ETC. USING A PLUNGER-CLEANED BLOW BOX SUITABLE FOR QUICK-SET SAND

[75] Inventor: Robert S. Lund, Elmhurst, Ill.

[73] Assignee: Pettibone Corporation, Chicago, Ill.

[21] Appl. No.: 342,071

[22] Filed: Jan. 25, 1982

[51] Int. Cl.[3] ..... B22C 15/28

[52] U.S. Cl. ..... 164/195; 164/201

[58] Field of Search ..... 164/38, 158, 200–202, 164/207, 195, 187

[56] References Cited

FOREIGN PATENT DOCUMENTS

| | | | |
|---|---|---|---|
| 0972225 | 5/1959 | Fed. Rep. of Germany | 164/201 |
| 54-61029 | 5/1979 | Japan | 164/200 |
| 55-149749 | 11/1980 | Japan | 164/207 |
| 0759207 | 8/1980 | U.S.S.R. | 164/202 |

*Primary Examiner*—Kuang Y. Lin
*Assistant Examiner*—Richard K. Seidel
*Attorney, Agent, or Firm*—Louis Robertson

[57] ABSTRACT

In foundry core-blowing, a blow box snugly fits a plunger which moves through it during the blowing step. In effect, the plunger pushes all of the fluidized sand mix out of the blow box and into the core box. This solves problems which have long impeded the use of quick setting sand mixes in blowing of cores and the like. With more conventional sand mixes better and more uniform packing of the sand in the mold is believed to be achieved. Two measuring feeders are provided supplying two different sand mixes which are non curing when separate but fast setting when mixed. They are mixed in a rapid mixer, dumped into a charging tube which quickly dumps the mix into a blow box. The plunger moves through the charging tube and then through the blow box, cleaning both and aiding in the blowing of all of the sand mix into the mold or the blow tube leading to it. The tip of the blow tube has an internal lip which breaks off any residue or plug retained within this tube.

8 Claims, 4 Drawing Figures

CONTROL SYSTEM
29B
29C
32C
30
CS
83
V
51
32B
31
28
27
78
57
22
58
24A
24B
26
34
36
RV
53
79
49
50
47
48a
2
55
38
33
42
44
46
56
52
41
21
19
43
45
37
11A
39
16
35
48
11
12
69
17
76
66
81
18
54
71
13
14
68

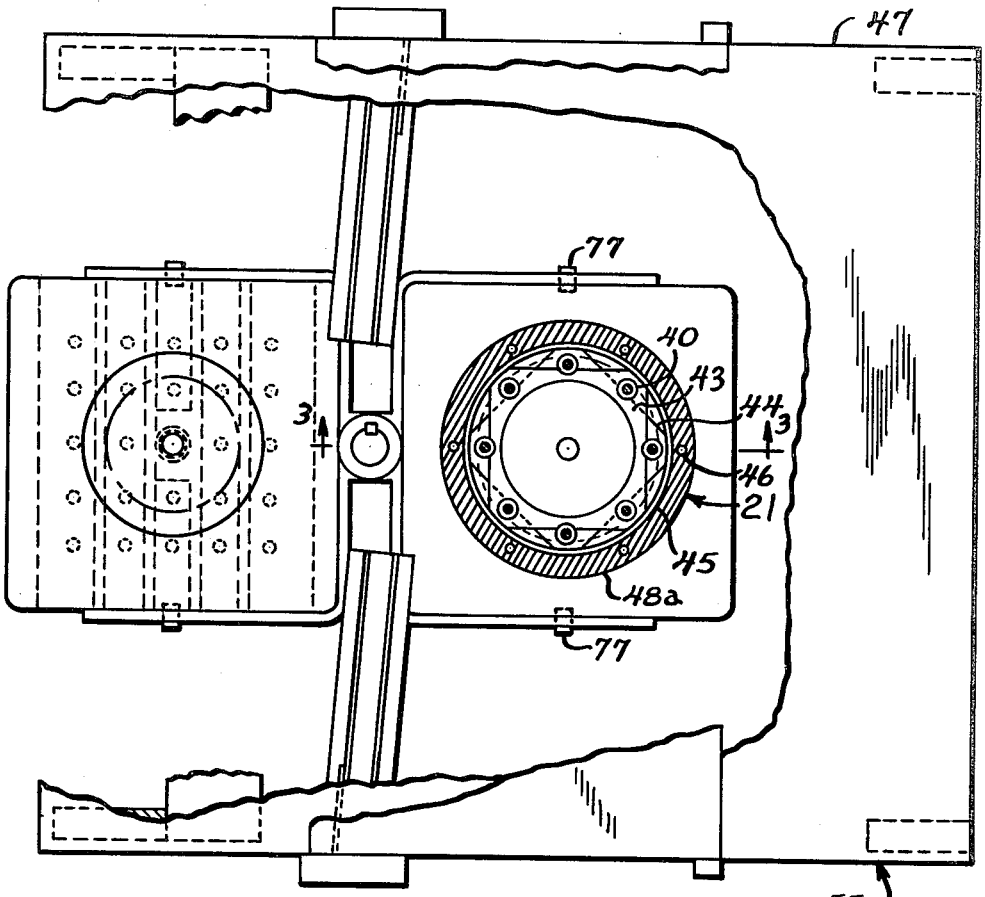
FIG. 2
FIG. 3
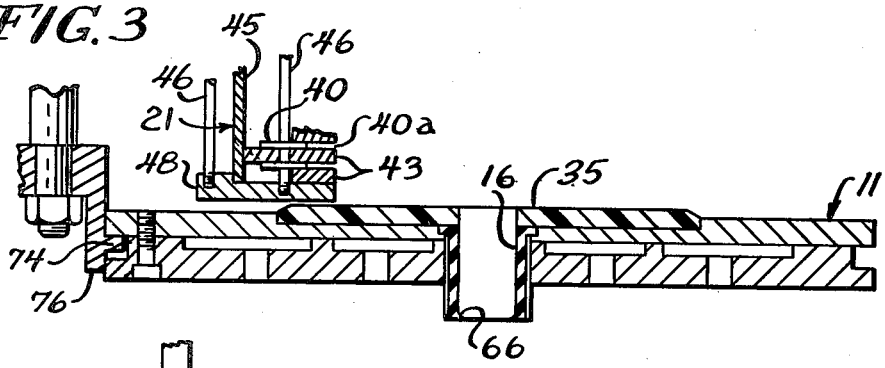
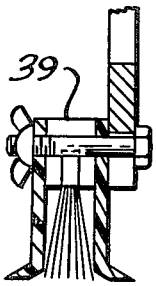
FIG. 4

METHOD AND APPARATUS FOR BLOWING CORES ETC. USING A PLUNGER-CLEANED BLOW BOX SUITABLE FOR QUICK-SET SAND

INTRODUCTION

The art of blowing sand into molds to form cores and the like is well developed. With the types of sand mixes for which this art has been used for many years, the art is very satisfactory. However, blowing into molds has not seemed commercially practical with more recent types of sand mixes using quick setting binders. With conventional blowing machines, considerable sand is retained in the blow box or other blowing equipment. Recognition that this would be disasterous with quick-setting sand (sand mixed with a quick-setting binder) has kept such sands from being used in blowing apparatus heretofore available.

According to the present invention, the problem is solved. The main key to its solution is the the use of a plunger moving through the blow box so that the blow box is not left with a chamber full of fluidized sand, and at the same time redesigning the blow box so that the plunger can wipe it clean. With each use, the total quantity of sand mix fed to the blow box will be blown into the mold, or substantially so. This has some advantage also with the slower setting conventional sand mixes.

The invention lends itself to the illustrated automatic machine, in which two conventional mixer-feeder units dump their respective non-curing mixes into the machine's mixer in which the combined mix becomes quick-setting so that the blowing must be completed within a few seconds. This is accomplished by dumping the quick-set mix into a swingable charging tube which "zips" to the mold-blowing position, where its charge falls into the special blow box of this invention. The plunger starts down, sealing the top of the charging tube, and almost simultaneously the blow begins. During its one-second continuation, the plunger moves on through the charging tube and the blow box, cleaning both, and ensuring that virtually all of the sand mix dumped into the charging tube is blown into the mold, through a conventional blow plate and its mold-engaging blow tube. Preferably there are two charging tubes, each with a blow plate spaced below it, and these are interchanged for each blow by an oscillating rotor. While the one not being used in a blow is being filled, a cleaning plunger can clean the idle blow tube.

The advantages of the invention will become more apparent from the following description and the drawings.

DESIGNATION OF FIGURES

FIG. 2 is a view, somewhat diagrammatic, looking downwardly approximately from the line 2—2 of FIG. 1.

FIG. 3 is a fragmentary vertical sectional view through a blow plate, and through a fragment of the blow box of FIG. 1.

FIG. 4 is a detail vertical sectional view through a brush and scraper unit.

Figure 1:
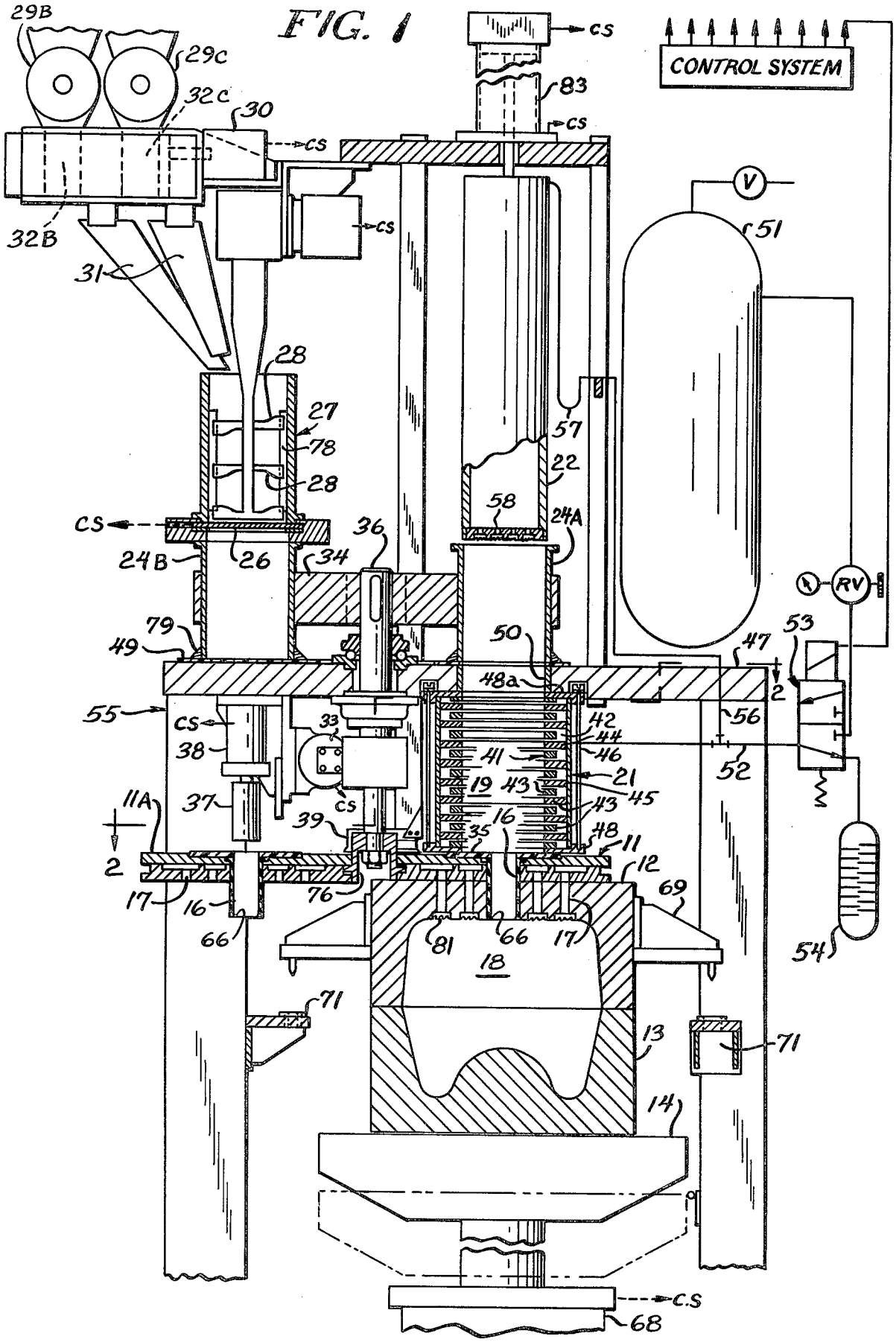
FIG. 1 is a view largely diagrammatic, but partly in vertical section, illustrating the principles of an automatic machine comprising a preferred form of the invention.

The figures are somewhat inconsistent, being schematic.

BACKGROUND DESCRIPTION

Foundry blowing machines for blowing a sand mix into molds have commonly included some sort of blow plate 11 for engaging a cope 12 which mates with a drag 13 to form a mold. It is common for the drag 13 to be clamped on a clamp table 14 which lowers the drag 13 after the sand mix filling the mold box 12,13 has set, thereby drawing the molded piece down from the cope to a position from which it may be removed manually or automatically.

It is common for the bow plate 11 to have a central blow tube 16 through which the sand mix is blown into the mold box, and to have vents 17 through which air can escape from the mold box.

Although some other aspects of the invention are also common to some degree, they are interrelated to the novelty described below, and are described therewith.

GIST OF PRESENT INVENTION

In essential terms, the gist of the invention is that the exact quantity of freshly mixed sand mix needed for filling the cavity 18 of mold box 12,13 is dumped into the central cavity 19 of blow box 21, and a plunger 22 which neatly fits the cavity 19 is moved down through it while air is simultaneously being blown into cavity 19 to fluidize the sand and blow it into the cavity 18 to fill this cavity; plunger 22 stripping all sand from the blow box 21. If there is any residue of unused sand mix, it is cleaned away before the next operation.

Being only slightly more specific with respect to FIG. 1, the dumping is by two interchanging magazine tubes 24A and 24B. While either is in the position over blow box 21 for dumping (as tube 24A is shown) the other is in a position for receiving its charge, as tube 24B is shown. Its charge is received by opening gate 26 to dump into the magazine tube 24B (or A) the freshly mixed contents of mixer 27 having rotary mixing paddles 28. When the charge has been dumped into the magazine tube, gate 26 is closed. Later the ingredients for another charge are fed to the rapid mixer 27. These ingredients comprise two different sand mixes, each stable until mixed with the other. These are mixed separately, as by mixers 29B and 29C. They are simultaneously discharged, each to its own funnel 31 by measuring dispensers 32B and 32C which may be simultaneously actuated by actuator 30. The letters "B" and "C" are chosen because in one the sand may be mixed with a binder or resin and in the other with a catalyst, as in epoxy cements.

When the cavity 18 has been filled, plunger 22 is withdrawn to its FIG. 1 position and and the two magazine tubes 24 A and B are interchanged as to their positions by oscillation motor 33 which swings the tube holder 34 through 180°. This dumps a new batch of sand mix into blow box 21, and places an empty magazine tube in place for receiving a new charge.

With quick setting sand mixes, it is important that no residue be left in the blow tube 16 or on the face of its "Teflon" pad 35. In order that these may be cleaned after each use, two interchanging blow plates 11 and 11A are provided. These are carried by the same shaft 36 that carries tube holder 34, so as to be oscillated 180° with the two magazine tubes 24A and B. While sand mix is being blown through one blow tube 16, the other is being cleaned by a plunger 37 projected through it by an actuator 38. As each blow plate 11 passes from the blow position to the cleaning position, it passes under one of the two brush-scraper units 39 to be cleaned by it on its upper surface, especially the surface of pad 35.

THE BLOW BOX

The blow box 21 is so constructed that it can be wiped clean during each use by the plunger 22. Its apertured cylinder 41 which separates its air chamber 42 from the central cavity 19 snuggly fits the plunger 22 so as to be wiped clean by it. In the form now preferred, it comprises a stack of annular plates 43 separated by very thin washers 40 to provide thin slots **40*a* between the plates. The plates all have the same internal diameter and are held accurately stacked to provide a smooth inner surface that can be wiped clean by the plunger 22. Of course the slits between the plates make this surface non-continuous, but the continuing blow of air through these slits ensures that sand wiped toward a slit by plunger 22 will be blown inwardly, toward the center of cavity 19. The plates 43 can be held accurately stacked by projecting tabs 44. These may have a press fit with the inner surface of shell 45, as seen in FIGS. 2, 3. Plates 43 may be held from angular shifting by tie rods 46, if some of these extend through these plates, as shown. The tie rods may extend down from top plate 48*a* to thread into bottom plate 48 of blow box 21**.

FURTHER DETAILS AND MODIFICATIONS

The preliminary mixer-feeders 29B,C may be batch fed or continuously fed, in either case supplying the proper proportions of sand and binder or catalyst, respectively. Unless these additives are liquids, easily mixed with the sand, foundry mullers may be used first. With any such advance mixing, the charging devices 32 B, C may merely measure out by weight or volume. However, mixing feeders 29B and 29C have been indicated, being preferred for the liquid additives most likely to be used for quick setting sand mixes. The broken line arrow "CS" merely indicates control by the control system indicated diagrammatically. This is also true of other "CS" arrows.

It would be possible to omit one of the two magazine tubes 24A,B, and one of the blow tubes 16. That would reduce the overall speed of production, however. In that event the timing of the discharges from measuring dispensers 32B,C would be delayed until there would barely be time for thorough mixing by the rapid mixer 27 before the single magazine tube 24A or B reached its receiving position. The two positions would not have to be separated by 180° however. Although the 180° movements of holder 34 and shaft 36 could be in the same direction, an oscillatory 180° actuator is readily available and of known accuracy and dependability.

The two magazine tubes 24A and B preferably slide along a smooth "Teflon" (or other non-stick, low friction and long wearing) surface 49. In the form illustrated, this is an annular surface, continuous except for its aperture over the blow box 21. This aperture, and the I.D. of sleeve 50 in deck plate 47 of the main frame 55 should be accurately of the same diameter as cavity 19 so as to be wiped clean by plunger 22, as are also the tubes 24A and B.

The control of compressed air to blow box 21 may be conventional. A tank of air supplied by a compressor, not shown, is indicated at 51. A line 52 to the blow box 21 (jacket space 42) is alternately connected by solenoid valve 53 to tank 51 or to discharge through muffler 54. According to the present invention, a branch line 56 leads from line 52 through flexible hose 57 to the inside of plunger 22, which is closed except for ports 58 in its leading end. These ports 58 maintain a supply of blowing air when the plunger has cut off the air flow through the slits in slit cylinder 41.

The entrance from cavity 18 to each vent passage 17 is provided with the conventional fine screen to block the escape of sand while permitting the escape of air. If these are pressed into recesses in the top wall of cope 12, as shown, they may need to be brushed clean, by a hand brush, or otherwise cleaned, after every few blows. If the cope 12 has an open top, with the screens in the bottom piece of blow plate 11 (or 11A) brushes similar to brushes 39 may be positioned to brush the screens clean during each 180° swing.

Although with the ideal use of this invention, the measuring dispensers 42B and C would measure out the precise amount of sand mix required to fill cavity 18 with no excess, it is probable that in actual practice a small excess will be provided to be sure to have enough. Because the lowered plunger 22 fills the space in cavity 19, the expected slight excess will substantially all be in blow tube 16, and will settle at the bottom of this tube upon the sudden cessation of the air blow at the end of the blow. It will usually be desirable to break this off of the core, and this may be accomplished by providing an internal lip 66 at the bottom of blow tube 16.

When the control system actuates elevator cylinder 68, the cope 12 is initially free to move downward, and tube 16, with its lip 66 breaks off the extra sand within the tube 16. When the cope 12 has been sufficiently lowered, the 180° swing will carry tube 16 with this broken off plug within it to the cleaning position represented by 11A in FIG. 1, and plunger 37 will eject the plug and any other residue of sand in tube 11. After that sufficient lowering of cope 12, its clamp ring 69 will come to rest on stops 71, and further downward movement of drag 13 by elevator cylinder 68 will draw the core or other molded piece from the cope 12. According to common practice, this draw should be at slow speed, although the cylinder 68 is then actuated at full speed to lower the drag 13 to the bottom position for unloading or stripping. The initial downward movement, before the draw starts, can be fast or slow. Because this initial lowering can take place while the piece's binder is setting, slow speed will probably be preferred. After unloading, the upward movement of elevating cylinder 68 can be at high speed, except that the cope must not be raised from stops 71 until the 180° swing has been completed so that the blow plate that was cleaned during the last blow is in place to receive cope 12. A slight amount of lost motion is provided in the mounting of the blow plates 11 and 11A. Each swings freely below blow box bottom plate 48 and then is raised up into sealing engagement with it by the rising cope 12. In the illustrated form this is accomplished by having the blow plate, e.g. 11, rest on an inward flange 74 on a U-frame 76 carried by shaft 36. Carrier or lost motion frame 76 should snugly position blow plate 11 with a sliding fit to let it be raised. Retainer screws 77 extend snugly into vertical slots in the edges of blow plates 11 to hold the blow plates in the U-frames with ready removability. If arcuate frames were used instead of U-frames, such pins would also prevent the blow plates from angular movement.

Plunger 22 preferably has a durable low-friction coating such as polyurethane.

A blow box 21 has been found to be satisfactory with its plates 43 ground flat and parallel with a thickness of 0.250 inch, and its washers 40 ground parallel with a thickness of 0.010 inch.

After assembly of the blow box 21, it is machined on its inner bore (the walls of cavity 18) to have a uniform snug sliding fit with plunger 22. This machining may extend through sleeve 50 and both of the charge or magazine tubes 24A and 24B. A snug fit between sleeve 50 and plunger 22, together with starting the air supply only when the plunger 22 has reached sleeve 50, safeguards against possible blowing of sand between the tube 24A or B at this position and the pad 49, if their sliding fit is not air-tight.

Although vent screens 81 have been shown in enlarged mouths of vents 17 formed in the cope 12, it is somewhat more common for the vent screens to be similarly positioned in the face of the blow plate, with the cope cavity 18 being exposed to the blow plate.

Ports 58 in plunger 22 should be similarly protected by vent screens, so that sand will not be blown backwards through these ports during venting through muffler 54.

The more basic features of this invention could be used with only one magazine tube, and only one blow plate much greater production can be achieved as illustrated. Also, the blow plate in the idle position can be hand-cleaned after each blow, if found necessary.

The blow plates 11 do not need to be especially designed for each core box. Vent ports in the blow plate that lie outside of the contact with the cope, or that are not aligned with cope vents, can just be unused, with no detriment.

It is expected that each batch of sand in rapid mixer 27 will scour off any residue left by the previous batch. Although the original binder on the individual particles may have set, these particles will be scattered through the new batch so as not to be a serious adulterant and probably pick up some fresh binder from them. If found necessary, vertically extending wiper blades 78 may be carried by mixing blades 28, to wipe the inner wall of rapid mixer 27.

Charging tubes 24A and 24B may be provided with conical base rings 79 to provide larger slide surfaces engaging pad 49, and to scrape this pad clean.

Apparatus for measuring out, by volume or by weight, is readily available, and therefore need not be disclosed here in detail.

The material at present preferred for blow tube 16 is Buna-N rubber. With less advantageous use of the invention, the blow tube can sometimes be omitted.

It is important that the slots for blowing air into the blow box be smaller than the smaller sand particles. The sand commonly used in foundries, passing 50 mesh and retained on 60 mesh, is larger than the 0.01 inch slits.

Some possible uses of the inventive concept are expected not to be the best uses. For example, the ports 58 could be omitted from plunger 22, but so far results without them have been inferior. The plunger 22 could pass snugly through a seal ring, and then have slight clearance from the wall of blow box cavity 19, or possibly even substantial clearance, at least if it is found that the air flow in this confined clearance prevents progressive build-up of sand accretions. It is expected that any means for displacing the fluidized sand toward the mold, preferably substantially all of the sand, would be beneficial as compared to practice heretofore. The sleeve 50 could in theory be omitted, as by machining the opening through deck 47 to fit the plunger 22 snugly. Or that fit could be loose and the fit with top wall **48*a* of blow box 21 (or a seal thereon) could be snug. It may be desirable to secure the blow box 21 to the deck 47 with slight self-accomodation, to be able to slide laterally in any direction minutely to accomodate itself to the position of plunger 22. The oscillating rotor 34,36,76** can be regarded as just one of a variety of means available for shifting parts from a blow position to an alternate position, or intershifting two sets of parts.

The positioning of bushes 39 now preferred is shown in FIG. 2. In FIG. 1 they are shown as if swung from this position, but this is for the sake of showing one in FIG. 1.

THE CONTROL SYSTEM

In FIG. 1, a control system has been indicated, but only diagrammatically. Such systems are so thoroughly within the common skill of the art that there is no need to encumber this application by the details of an example. It may help the designer, however, to set forth a schedule of actuations that is believed to be suitable, assuming a 24 pound core is being blown and that the freshly mixed sand has a 15 second curing time. Each item begins with a number in the margin that represents the number of seconds from the start of the cycle.

0. Start the control unit, either by automatic operation of a stripping unit that has completed removing the piece molded, or by button pressing. The latter would preferably require pressing two buttons so located that the operator is safe.

0.5 Start elevating clamp table 14 and drag 13 from its lowermost position where drag 13 was stripped to the position in which it closes against the cope resting on stops 71. Allow 2½ sec.

2. Dump the premeasured amounts of the two noncuring sand mixes into the fast mixer. Unless mixer motor runs constantly, start it, perhaps after ½ sec.

4.5 Open gate 26 to dump mix into charger tube 24A or B.

5. Energize swing cylinder 33 to swing the oscillating rotor through 180° (clockwise one time, counterclockwise the next). 1.75 seconds is allowed for the swinging movement.

6.75 Finish the elevating of clamp table 14, pressing cope 12 against the blow plate 11, and this against the blow box 21. Also, at about this time the gate 26 is closed, and the motor of the rapid mixer 27 may be stopped.

7.5 Start the plunger 22 downwardly by fluid to top of cylinder 83.

8.5 (Or by signal when the plunger 22 enters the sleeve 50), actuate solenoid valve 53 to supply pressured air. The air will go both to shell 45 of blow box 21 and to the inside of plunger 22. Also (or any time after the 180° swing is completed) start cleaning plunger 37 through the idle blow tube.

9.5 Deenergize the solenoid valve 53 to exhaust the blowing air from the blow box 21 and plunger 22 through muffler 54. If an adjustable time delay device for curing time is provided, as is preferred, actuate it.

19.5 or when the time delay expires, or at set earlier time, lower clamp table 14 at least slightly, or until clamp ring 69 rests on stops 71. An initial movement before curing strength has developed helps lip 66 break off any plug within tube 16.

20. or at end of full cure time, lower clamp table 14 slowly for "slow draw" separation of drag 13 from cope 12, using restricted hydraulic flow in line controlling the cylinder 68.

20.5 Lower clamp table 14 the rest of the way by unrestricted flow. Also raise plunger 22 from the blow box 21 to its top position. Stripping may start as soon as the drag is all of the way down. In fact, the final movement of the drag can cause stripper pins to separate the molded piece from the drag. During the stripping period, if not before, the measuring or filling of measuring dispensers 32B and C should be started. If gates are provided for discharge of the non-curing mixes to the measuring device, these gates may now be opened.

ACHIEVEMENT

From the foregoing it is seen that the problem of using fast setting sand mixes in the blowing of cores and other foundry pieces has been solved. Even with ordinary mixes, wastage can be reduced, and more uniform packing of molds can be achieved.

I claim:

1. The combination of a foundry blow box for blowing sand from the blow box into a mold, said box having a sand receiving cavity leading to a blowing exit and being constructed for the supply of fluidizing air to said cavity; and displacement means moving within the cavity for displacing the sand in the cavity to cause more complete removal of the sand from the cavity through said exit during a blow.

2. The combination of a foundry blow box for blowing sand into a mold, said box having a sand receiving cavity leading to a blowing exit and constructed for supply of air to the cavity for fluidizing and blowing the sand; and a plunger moving into said cavity as a displacement means displacing the fluidized sand toward said exit.

3. The combination of a foundry blow box for blowing sand into a mold, said box having a cavity of uniform transverse dimensions surrounded by a wall and constructed for supply of air to the cavity for fluidizing the sand and blowing it through said exit and a plunger moving into said cavity toward said exit as a displacement means displacing the fluidized sand toward said exit.

4. The combination of blow box and displacement means according to claim 1, 2 or 3, in which the displacement means ultimately substantially fills the cavity to displace substantially all sand therefrom.

5. The combination of blow box and displacement means according to claim 1, 2 or 3 in which the structure for the supply of fluidizing air to the cavity of the blow box includes a stack of plates, each surrounding the cavity, and jointly forming the sand-receiving cavity, and the plates are separated by very thin separated spacers.

6. The combination of blow box and displacement means according to claim 1, 2 or 3 in which the blow box includes a cylindrical shell and a stack of plates aligned by engagement with the inside of the shell, jointly forming said cavity, and having noncircular edges forming with the shell an air supply space for blowing air between the plates, the plates being separated by very thin separated spacers.

7. The combination of blow box and displacement means according to claim 3 in which the blow box includes a cylindrical shell and a stack of plates aligned by engagement with the inside of the shell, jointly forming said cavity, and having noncircular edges forming with the shell an air supply space for blowing air between the plates, the plates being separated by very thin separated spacers; the plate portions forming the cavity being machined to provide a smooth bore, and the plunger sliding smoothly and snugly on said plates to clean them and displace all fluidized sand.

8. The combination of a blowbox for blowing sand from the blowbox into a mold, said blowbox having a sand-receiving cavity leading to a blowing exit and constructed for the supply of air into said cavity for fluidizing sand in the cavity and blowing it through the exit; and displacement means moving within the cavity for displacing the sand in the cavity to cause more complete removal of the sand from the cavity through the exit, by the occupying of the cavity by the displacement means to the exclusion of the air-fluidized sand from the space in the cavity occupied by the displacement means.

* * * * *